US008381358B1

(12) United States Patent
Frey

(10) Patent No.: US 8,381,358 B1
(45) Date of Patent: Feb. 26, 2013

(54) UNIVERSAL HANDLE

(76) Inventor: Mark Frey, Waccabue, NY (US)

( * ) Notice: Subject to any disclaimer, the term of this patent is extended or adjusted under 35 U.S.C. 154(b) by 0 days.

(21) Appl. No.: 13/136,152

(22) Filed: Jul. 25, 2011

Related U.S. Application Data

(60) Provisional application No. 61/413,360, filed on Nov. 12, 2010.

(51) Int. Cl.
*A45C 13/22* (2006.01)
*B25G 1/00* (2006.01)

(52) U.S. Cl. ..... 16/426; 16/422; 16/444; 16/406

(58) Field of Classification Search ..... 16/426, 16/429, 408, 436, 444; 81/177.8, 177.3, 81/177.1, 177.75; 408/124, 241 R; 294/58
See application file for complete search history.

(56) References Cited

U.S. PATENT DOCUMENTS

| | | | | | |
|---|---|---|---|---|---|
| 1,083,054 | A | * | 12/1913 | Brown | 294/58 |
| 4,050,728 | A | * | 9/1977 | Davidson | 294/58 |
| 4,980,805 | A | * | 12/1990 | Maglica et al. | 362/191 |
| 5,054,830 | A | * | 10/1991 | Nisenbaum | 294/58 |
| 5,133,582 | A | * | 7/1992 | Rocha | 294/58 |
| 5,474,350 | A | * | 12/1995 | Gauthier | 294/58 |
| 5,484,182 | A | * | 1/1996 | Meisner | 294/165 |
| 6,062,619 | A | * | 5/2000 | Clark, Jr. | 294/58 |
| 6,283,522 | B1 | * | 9/2001 | Renaud | 294/58 |
| 6,581,246 | B1 | * | 6/2003 | Polette | 16/429 |
| 7,124,474 | B2 | * | 10/2006 | Nicolay et al. | 16/436 |
| 2003/0132079 | A1 | * | 7/2003 | Bellini | 190/115 |
| 2008/0196205 | A1 | * | 8/2008 | Hixon | 16/426 |

FOREIGN PATENT DOCUMENTS

| | | | |
|---|---|---|---|
| JP | 09109065 | A * | 4/1997 |
| JP | 2006321008 | A * | 11/2006 |

* cited by examiner

*Primary Examiner* — Chuck Y. Mah

(74) *Attorney, Agent, or Firm* — Robert M. Sperry

(57) ABSTRACT

A universal handle which can quickly and easily be attached to substantially any desired article and which is ergonomically designed to be comfortable to carry and which fold into itself for convenient storage when not in use.

5 Claims, 4 Drawing Sheets

UNIVERSAL HANDLE

RELATED CASES

This invention is described in my provisional application Ser. No. 61/413,360, filed Nov. 12, 2010 and now abandoned.

FIELD OF INVENTION

This invention relates to article handling and is particularly directed to improved handles which can be attached to any desired article to facilitate handling thereof.

BACKGROUND

Many articles are bulky and difficult to move from place to place, such as infant seats, coolers and the like. Other articles are provided with handles which tend to cut into a person's hand, such as plastic grocery bags and the like. Unfortunately little or nothing has been done to alleviate these problems.

BRIEF SUMMARY AND OBJECTS OF INVENTION

These disadvantages of the prior art are overcome with the present invention an universal handles are provided which can quickly and easily be attached to virtually any desired article and which are convenient and comfortable to carry.

These advantages of the present invention are preferably attained by providing a universal handle which can quickly and easily be atttached to substantially any desired article and which is ergonomically designed to be comfortable to carry and which fold into itself for convenient storage when not in use.

Accordingly it is an object of the present invention to provide a universal handle which can be attached to substantially any desired article.

Another object of the present invention is to provide a universal handle which can quickly and easily be attached to substantially any desired article.

A further object of the present invention is to provide a universal handle which can quickly and easily be attached to substantially any desired article and which is ergonomically designed.

An additional object of the present invention is to provide a universal handle which can quickly and easily be attached to substantially any desired article and which is ergonomically designed and which is comfortable to carry.

A specific object of the present invention is to provide a universal handle which can quickly and easily be atttached to substantially any desired article and which is ergonomically designed to be comfortable to carry and which fold into itself for convenient storage when not in use.

These and other objects and features of the present invention will be apparent from the following detailed description, taken with reference to the figures of the accompanying drawing.

DETAILED DESCRIPTION OF THE INVENTION

Figure 1:
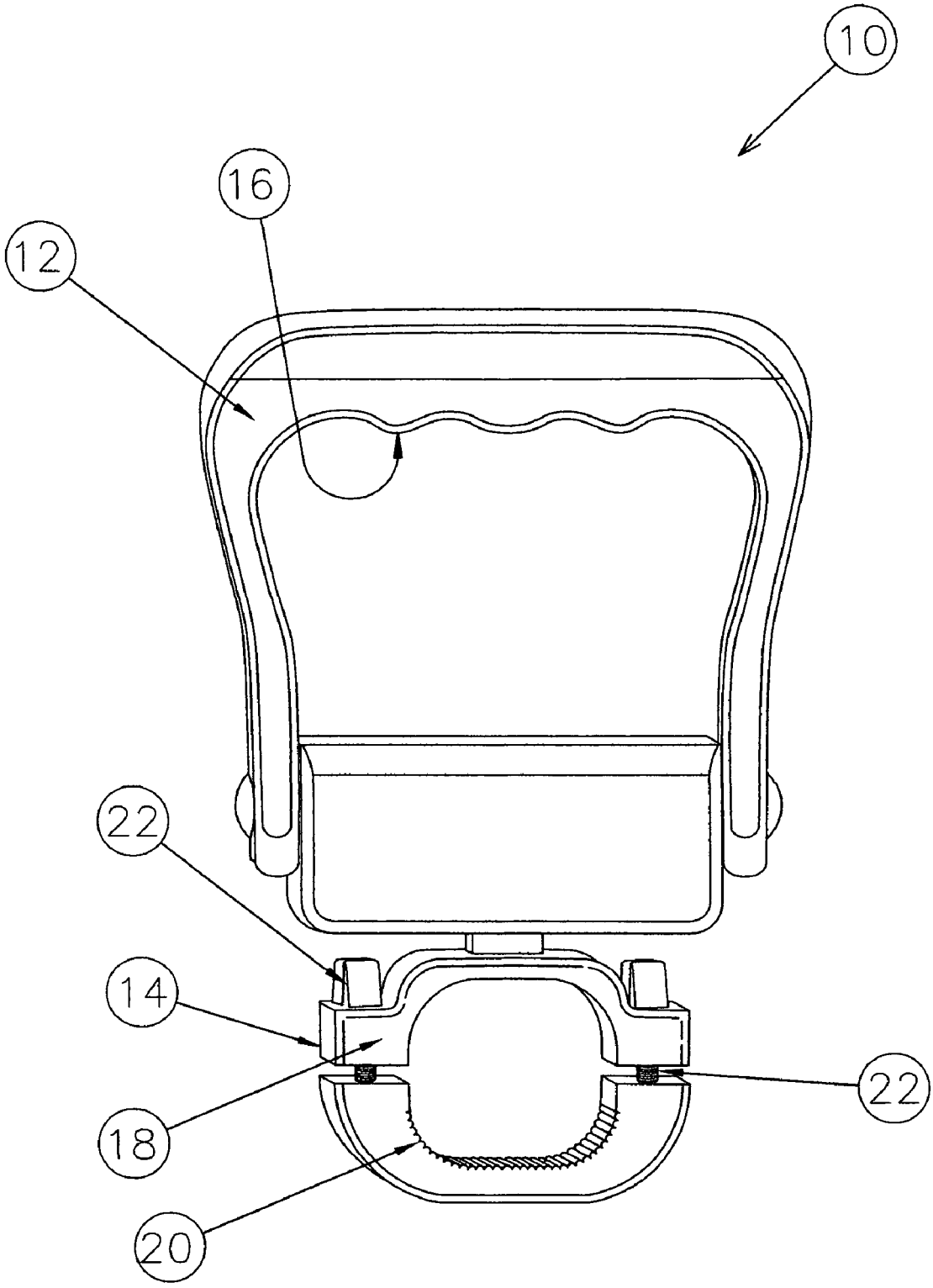
FIG. 1 is a front view of a universal handle embodying the present invention.
Figure 2:
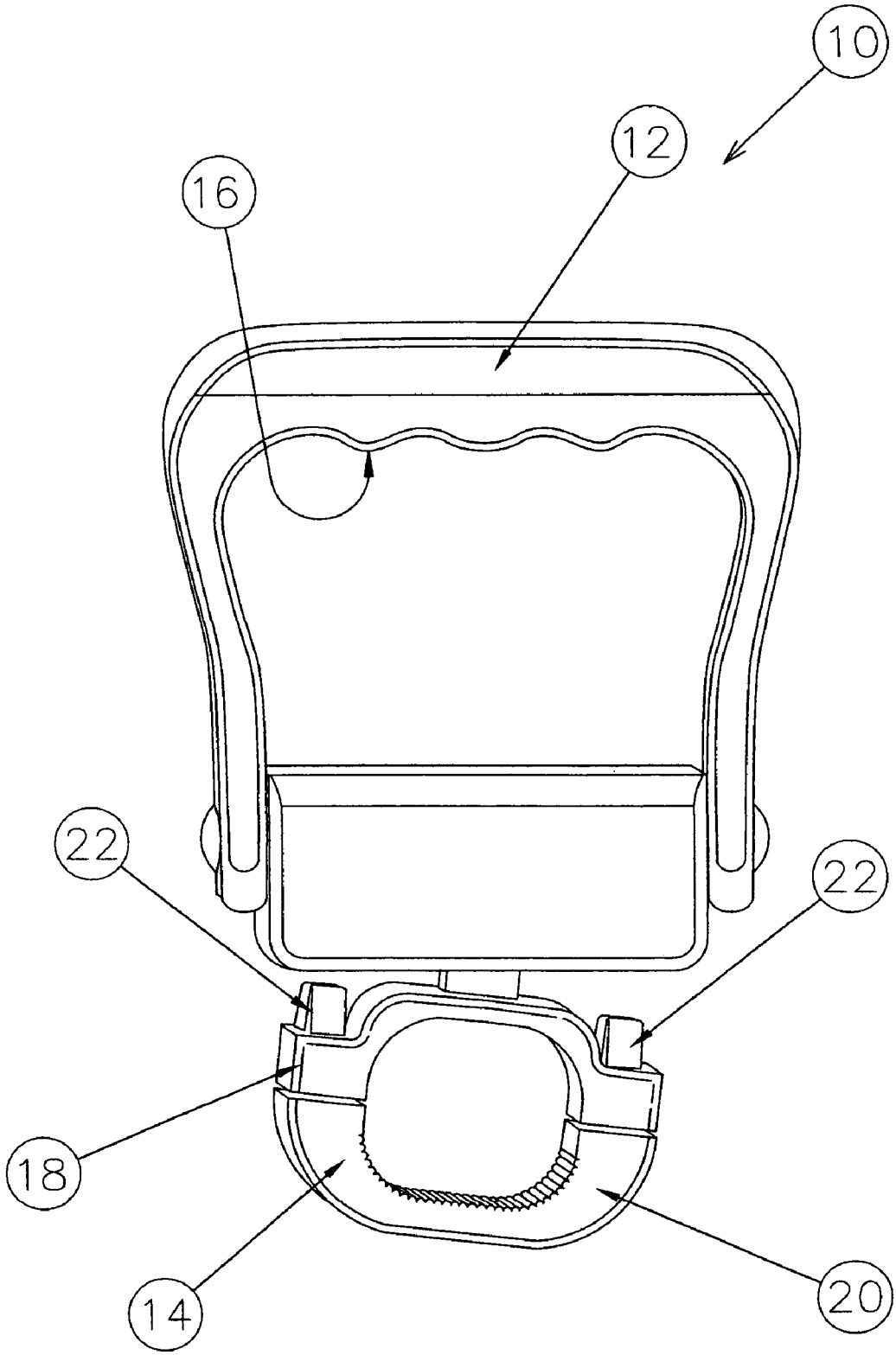
FIG. 2 is a front view of the universal handle of FIG. 1, showing the clamp portion tilted to one side.
Figure 3:
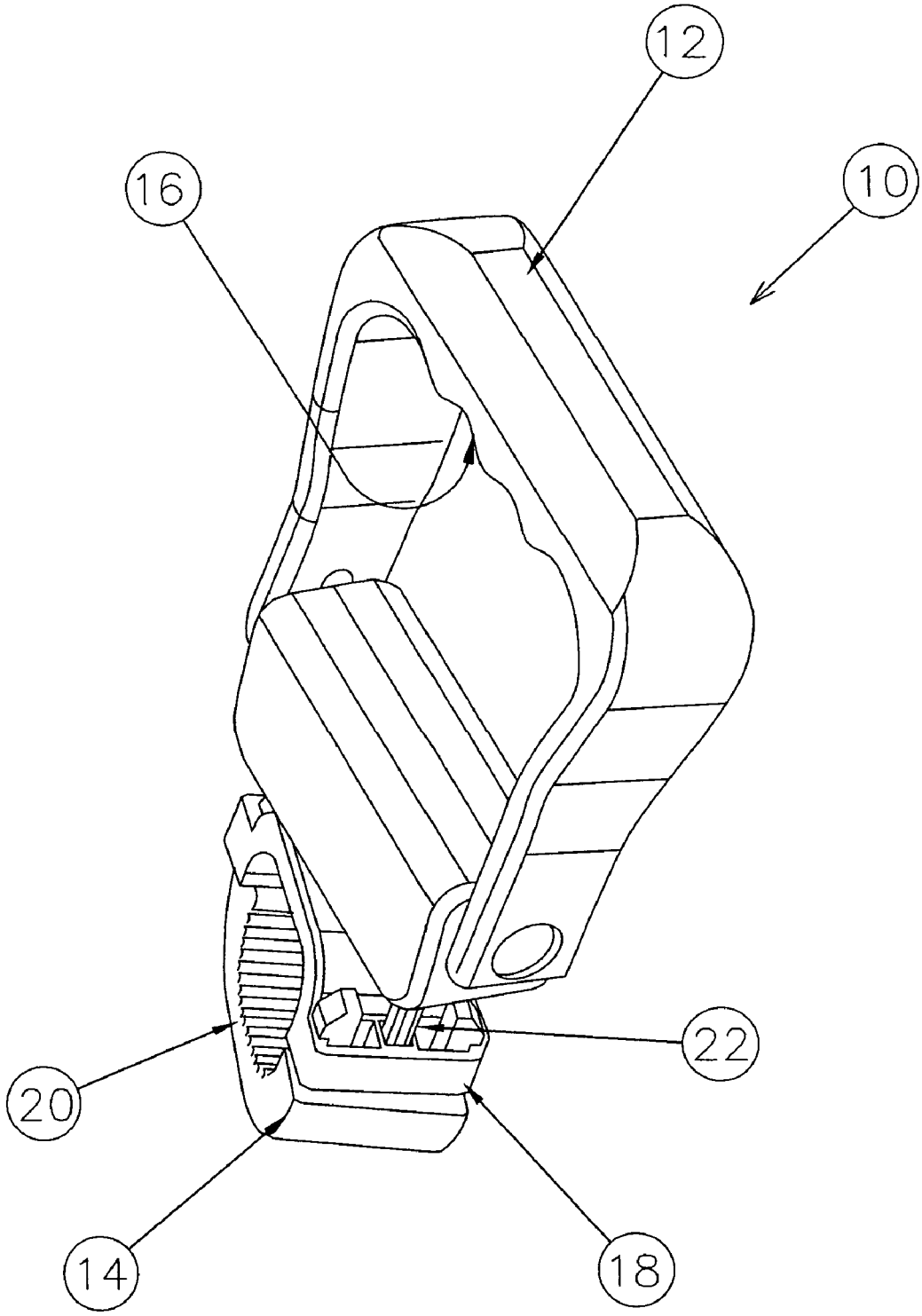
FIG. 3 is a side view of the universal handle of FIG. 1 shown with the clamp portion twisted.
Figure 4:
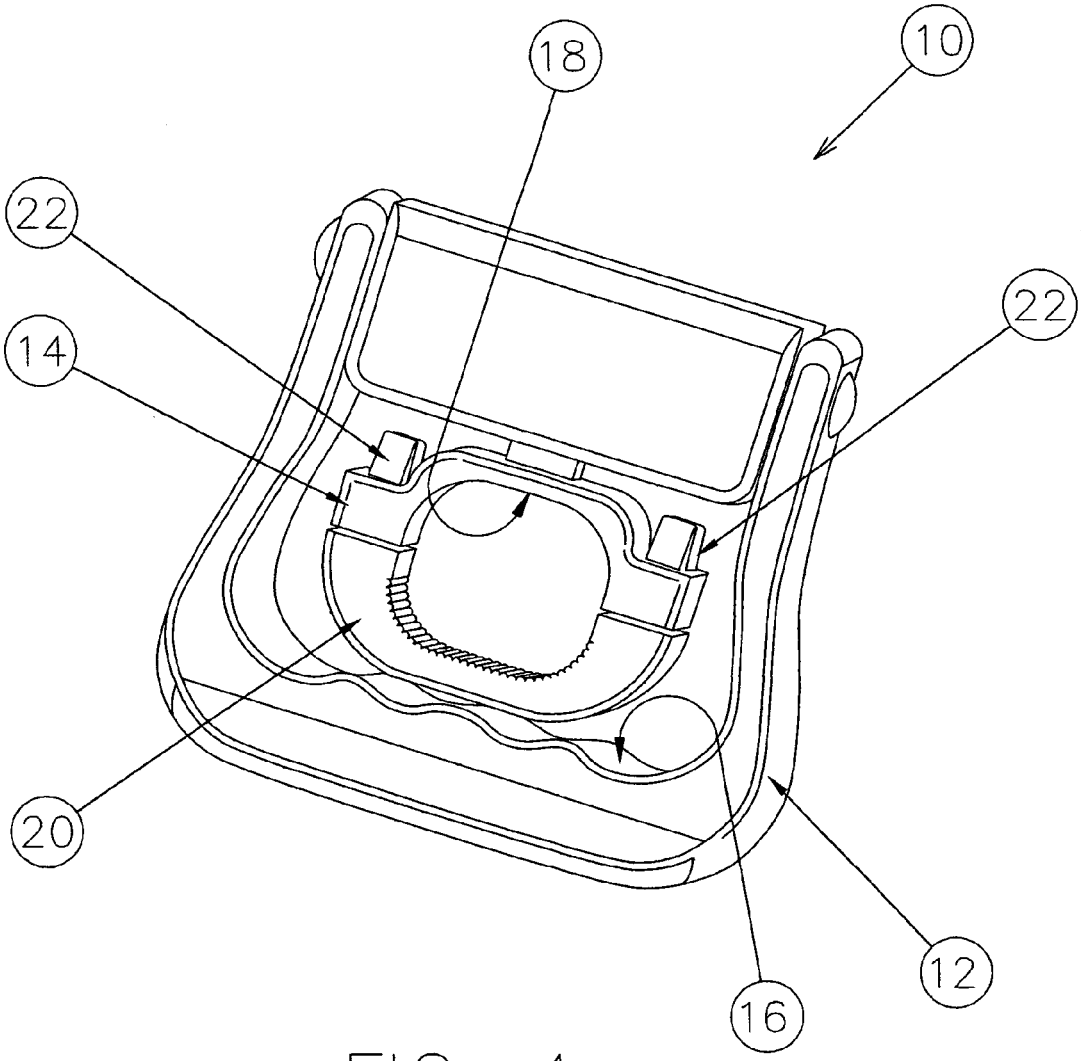
FIG. 4 is a front view of the universal handle of FIG. 1 showing the clamp portion folded into the handle for storage.

In that form of the present invention chosen for purposes of illustration, FIG. 1 shows a universal handle, indicated generally at 10 having a handle portion 12 and a clamp portion 14. The clamp portion 14 is attached to the handle portion 12 by a universal joint which allows the clamp portion 14 to tilt, as seen in FIG. 2, and to rotate, as seen in FIG. 3. Also, the handle portion 12 is ergonomically designed, as indicated at 16, to comfortably fit a human hand. Finally, the clamp portion 14 comprises an upper arcuate member 18 and a lower arcuate member 20 which are releasably secured together by suitable means, such as bolts 22. Also, the clamp portion 14 is pivotally connected to the handle portion 12 to enable the clamp portion 14 to be folded into the handle portion 12, as seen in FIG. 4 for compact and convenient storage.

In use, the lower arcuate member 20 of the clamp portion 14 is removed and inserted through any suitable opening on the article to be carried and is then reattached to the upper arcuate member 18 by bolts 22. Thereafter, the article can be comfortably carried by the user. When it is desired to store the universal handle 10, the clamp portion 14 is folded into the handle portion 12, as seen in FIG. 4, for compact, convenient storage.

Obviously, numerous variations and modifications can be made without departing from the spirit of the present invention. Therefore, it should be clearly understood that the form of the present invention described above and shown in the figures of the accompanying drawing are illustrative only and are not intended to limit the scope of the present invention.

What is claimed is:

1. A universal handle comprising:

a handle portion, adapted to be held by a user's hand, comprising a generally U-shaped upper portion pivotally connected to a generally rectangular lower portion; and a clamp portion, adapted to be attached to an article to be carried, tiltably and rotatably attached to said rectangular lower portion of said handle portion by a universal joint.

2. The universal handle of claim 1 wherein:

said rectangular lower portion and said clamp portion attached thereto can be folded to lie substantially within said U-shaped upper handle portion for storage.

3. The universal handle of claim 1 wherein:

said handle portion is ergonomically formed.

4. The universal handle of claim 1 wherein:

said clamp portion comprises an upper arcuate member and a lower arcuate member secured to said upper arcuate member.

5. The universal handle of claim 1 wherein:

said clamp portion comprises an upper arcuate member and a lower arcuate member secured to said upper arcuate member by bolts.

* * * * *